US008585384B2

(12) United States Patent
Kuroda et al.

(10) Patent No.: US 8,585,384 B2
(45) Date of Patent: Nov. 19, 2013

(54) ROTARY PUMP INCLUDING INNER ROTOR AND OUTER ROTOR HAVING DIFFERENT AXIAL SIZE OF AN AXIAL CLEARANCE

(75) Inventors: Tomonobu Kuroda, Chiryu (JP); Kenichi Oishi, Toyokawa (JP)

(73) Assignee: Denso Corporation, Kariya (JP)

( * ) Notice: Subject to any disclaimer, the term of this patent is extended or adjusted under 35 U.S.C. 154(b) by 111 days.

(21) Appl. No.: 13/048,085

(22) Filed: Mar. 15, 2011

(65) Prior Publication Data

US 2011/0229361 A1 Sep. 22, 2011

(30) Foreign Application Priority Data

Mar. 16, 2010 (JP) ..... 2010-58864

(51) Int. Cl.
*F03C 2/00* (2006.01)
*F03C 4/00* (2006.01)
*F04C 2/00* (2006.01)

(52) U.S. Cl.
USPC ..... 418/171; 418/75; 418/132

(58) Field of Classification Search
USPC ..... 418/75, 79, 102, 131–132, 166, 171
See application file for complete search history.

(56) References Cited

U.S. PATENT DOCUMENTS

| | | | | |
|---|---|---|---|---|
| 3,695,791 | A * | 10/1972 | Brundage | 418/171 |
| 3,834,842 | A * | 9/1974 | Dorff et al. | 418/171 |
| 6,905,321 | B2 * | 6/2005 | Uchiyama et al. | 418/171 |
| 2003/0227216 | A1 | 12/2003 | Uchiyama et al. | |
| 2007/0231176 | A1 * | 10/2007 | Asai et al. | 418/171 |
| 2008/0213117 | A1 * | 9/2008 | Hosono | 418/171 |

FOREIGN PATENT DOCUMENTS

| | | |
|---|---|---|
| JP | 6-25582 | 4/1994 |
| JP | 2004-176676 | 6/2004 |

OTHER PUBLICATIONS

Office Action issued for Japanese Patent Application No. 2010-058864, dated Jul. 12, 2013 (5 pages).

* cited by examiner

*Primary Examiner* — Theresa Trieu
(74) *Attorney, Agent, or Firm* — Nixon & Vanderhye P.C.

(57) ABSTRACT

A housing includes a pump chamber, which rotatably receives an inner rotor and an outer rotor that define a pressure chamber therebetween. An inlet port of the housing is communicated with the pressure chamber to supply fluid into the pressure chamber. An outlet port of the housing is communicated with the pressure chamber to discharge the fluid from the pressure chamber. An axial size of an axial clearance, which is formed between an axial end surface of the pump chamber and an axial end surface of the inner rotor, differs from an axial size of an axial clearance, which is formed between the axial end surface of the pump chamber and an axial end surface of the outer rotor.

4 Claims, 8 Drawing Sheets

ROTARY PUMP INCLUDING INNER ROTOR AND OUTER ROTOR HAVING DIFFERENT AXIAL SIZE OF AN AXIAL CLEARANCE

CROSS REFERENCE TO RELATED APPLICATION

This application is based on and incorporates herein by reference Japanese Patent Application No. 2010-58864 filed on Mar. 16, 2010.

BACKGROUND OF THE INVENTION

1. Field of the Invention

The present invention relates to a rotary pump.

2. Description of Related Art

An internal gear pump, which pumps fluid (e.g., oil), is known. In general, the internal gear pump includes an inner rotor, which has external teeth along an outer peripheral part thereof, and an outer rotor, which has internal teeth along an inner peripheral part thereof. The inner rotor and the outer rotor are arranged eccentric to each other while the external teeth of the inner rotor and the internal teeth of the outer rotor are meshed with each other. When the inner rotor and the outer rotor are rotated, a volume of a pressure chamber, which is formed between the external teeth and the internal teeth, changes, so that the fluid is drawn and discharged at the gear pump.

When a volumetric efficiency of the internal gear pump, which is a ratio between an actual discharge rate and a theoretical discharge rate (or a ratio between an actual flow rate and a theoretical flow rate) of the internal gear pump, needs to be increased, it is required to minimize each corresponding clearance, such as a clearance between the inner rotor and a housing, and a clearance between the outer rotor and the housing. For instance, in Japanese Unexamined Patent Publication No. 2004-11520A (US200310227216A1), a side plate is placed on a side of the outer rotor, and the discharge pressure of the fluid is applied to a back surface of the side plate to reduce the size of the clearance and thereby to improve the sealing performance. In this way, the volumetric efficiency is improved.

When the clearance between the inner rotor and the housing or between the outer rotor and the housing is decreased, like in the case of Japanese Unexamined Patent Publication No. 2004-11520A (US2003/0227216A1), a drive torque, which is required to drive the pump, is disadvantageously increased. Furthermore, in the case of Japanese Unexamined Patent Publication No. 2004-11520A (US2003/0227216A1), the additional components, such as the side plate, are required, so that the structure of the pump is disadvantageously complicated, and the number of the components of the pump is disadvantageously increased.

SUMMARY OF THE INVENTION

The present invention addresses the above disadvantage. According to the present invention, there is provided a rotary pump, which includes a shaft, a drive device, an inner rotor, an outer rotor and a housing. The shaft is rotatable. The drive device generates a rotational drive force to rotate the shaft. The inner rotor includes a plurality of external teeth and is adapted to be rotated integrally with the shaft by the rotational drive force, which is received from the drive device. The outer rotor includes a plurality of internal teeth meshed with the plurality of external teeth and is placed eccentric to the inner rotor on a radially outer side of the inner rotor. The inner rotor and the outer rotor form a pressure chamber therebetween, and a volume of the pressure chamber is variable upon rotation of the inner rotor. The housing includes an inlet port, an outlet port and a pump chamber. The inlet port is communicated with the pressure chamber to supply fluid into the pressure chamber. The outlet port is communicated with the pressure chamber to discharge the fluid from the pressure chamber. The pump chamber receives the inner rotor and the outer rotor in a rotatable manner. An axial size of an axial clearance, which is formed between an axial end surface of the pump chamber and an axial end surface of the inner rotor, differs from an axial size of an axial clearance, which is formed between the axial end surface of the pump chamber and an axial end surface of the outer rotor.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

A rotary pump according to an embodiment of the present invention will be described with reference to the accompanying drawings.

The rotary pump of the present embodiment is implemented as an oil pump, which supplies hydraulic oil to an automatic transmission of a vehicle (specifically, an automobile).

Figure 1:
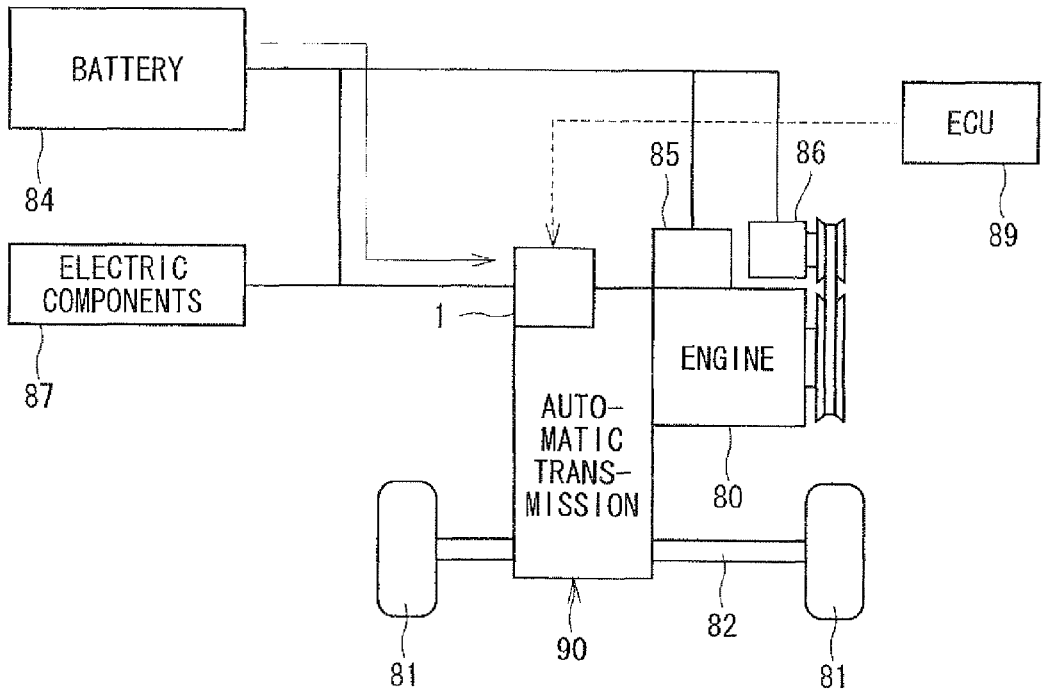
FIG. 1 is a block diagram showing an entire structure of an automatic transmission system having an electric pump according to an embodiment of the present invention.

FIG. 1 shows an entire structure of a system of the present embodiment.

An engine (internal combustion engine) 80 is a drive source of the vehicle, and a crankshaft (not shown) of the engine 80 is mechanically connected to a drive shaft 82, which connects between left and right driving wheels 81 of the vehicle. The automatic transmission 90 is provided in a transmission system, which transmits a drive force from the crankshaft to the driving wheels 81. The automatic transmission 90 has an electric pump 1, which serves as a rotary pump.

A battery 84 is connected to the electric pump 1, a starter 85, an alternator 86 and other electric components 87. The starter 85 provides initial rotational force to the crankshaft of the engine 80. The alternator 86 is mechanically connected to the crankshaft of the engine 80 and converts a kinetic energy, which is transmitted from the crankshaft, to an electrical energy. The converted electrical energy is charged in the battery 84. The electric components 87 include, for example, an air conditioning apparatus, headlights and a fuel injection apparatus. An electronic control unit (ECU) 89 includes a known microcomputer as its main component. The ECU 89 executes an idle reduction control operation (also referred to as an idling-stop control operation), which automatically stops the engine 80 at the time of temporarily stopping the vehicle at, for instance, a red traffic light. The ECU 89 also executes an automatic restart control operation, which automatically restarts the engine 80 after the stopping of the engine 80 in the idle reduction control operation. Furthermore, the ECU 89 controls the electric power supply to the electric pump 1. Electrical connections of the ECU 89 other than a control line connected to the electric pump 1 are not depicted in FIG. 1 for the sake of simplicity.

Figure 2:
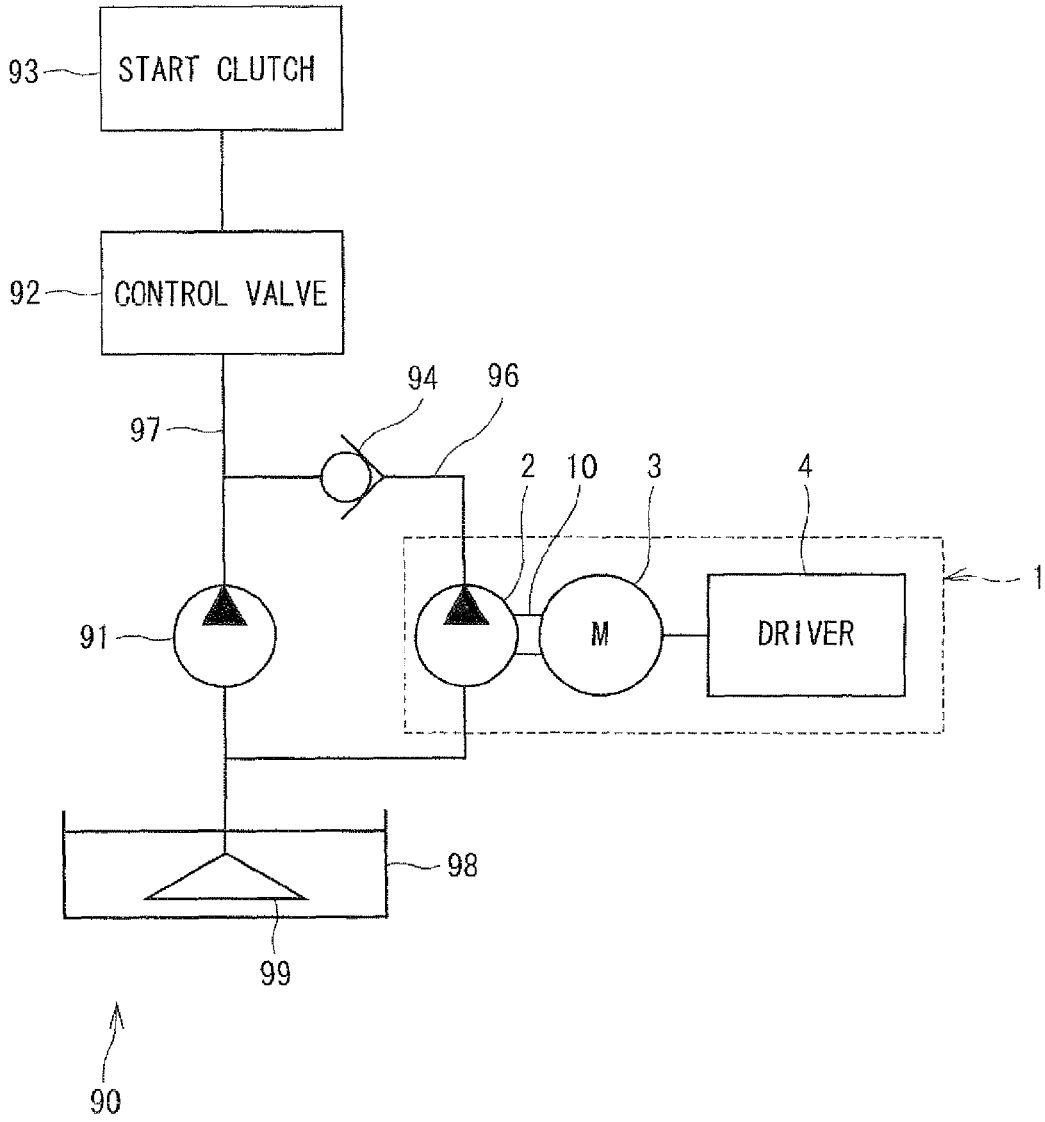
FIG. 2 is a schematic diagram showing a hydraulic circuit of an automatic transmission having the electric pump of the embodiment.

FIG. 2 shows a structure of a hydraulic circuit of the automatic transmission 90. The automatic transmission 90 includes the electric pump 1, a mechanical hydraulic pump 91, a control valve 92, friction engagement elements (including a start clutch 93), and a check valve 94.

The mechanical hydraulic pump 91 is driven by the engine 80. The mechanical hydraulic pump 91 draws the oil, which is stored in an oil pan 98, through a strainer 99 and then supplies the drawn oil to the friction engagement elements through a hydraulic passage 97 and the control valve 92.

The electric pump 1 is provided in parallel to the mechanical hydraulic pump 91. The electric pump 1 is placed in a bypass passage 96 and includes a pump device 2 and an electric motor device (serving as a drive device) 3. The pump device 2 and the motor device 3 are connected with each other through a shaft 10. The motor device 3 is electrically controlled by a driver 4. The electric pump 1 is driven during the idle reduction period (i.e., the engine stop period during which the engine is stopped by the idle reduction control operation) to supply the hydraulic pressure to the start clutch 93.

The bypass passage 96 is connected to the hydraulic passage 97 on a downstream side of the mechanical hydraulic pump 91. The check valve 94 is provided between the electric pump 1 and a connection between the bypass passage 96 and the hydraulic passage 97. The check valve 94 opens when the hydraulic pressure in the bypass passage 96 becomes larger than the hydraulic pressure in the hydraulic passage 97. In this way, the check valve 94 limits the backflow of the hydraulic fluid, which is discharged from the mechanical hydraulic pump 91, toward the electric pump 1 during the running period (driving period) of the engine 80.

As discussed above, according to the present embodiment, the idle reduction control operation is executed to automatically stop the engine 80 at the time of stopping the vehicle. When the engine 80 is stopped, the mechanical hydraulic pump 91, which is driven by the engine 80, is stopped. When the mechanical hydraulic pump 91 is stopped, the hydraulic fluid, i.e., oil cannot be supplied to the friction engagement elements while the oil is continuously drained from the friction engagement elements. Thus, the quantity of the oil becomes insufficient, and thereby the hydraulic pressure is reduced. Thereafter, when the engine 80 is restarted from the state where the hydraulic pressure of the start clutch 93 is dropped, a transmission shock is generated.

Therefore, the electric pump 1 is driven during the stop period of the engine 80, i.e., during the stop period of the mechanical hydraulic pump 91. Thereby, the oil is supplied from the electric pump 1 to the start clutch 93 through the bypass passage 96 and the control valve 92, so that the hydraulic pressure of the start clutch 93 is maintained. As a result, the transmission shock can be reduced at the time of restarting the engine 80.

Figure 3:
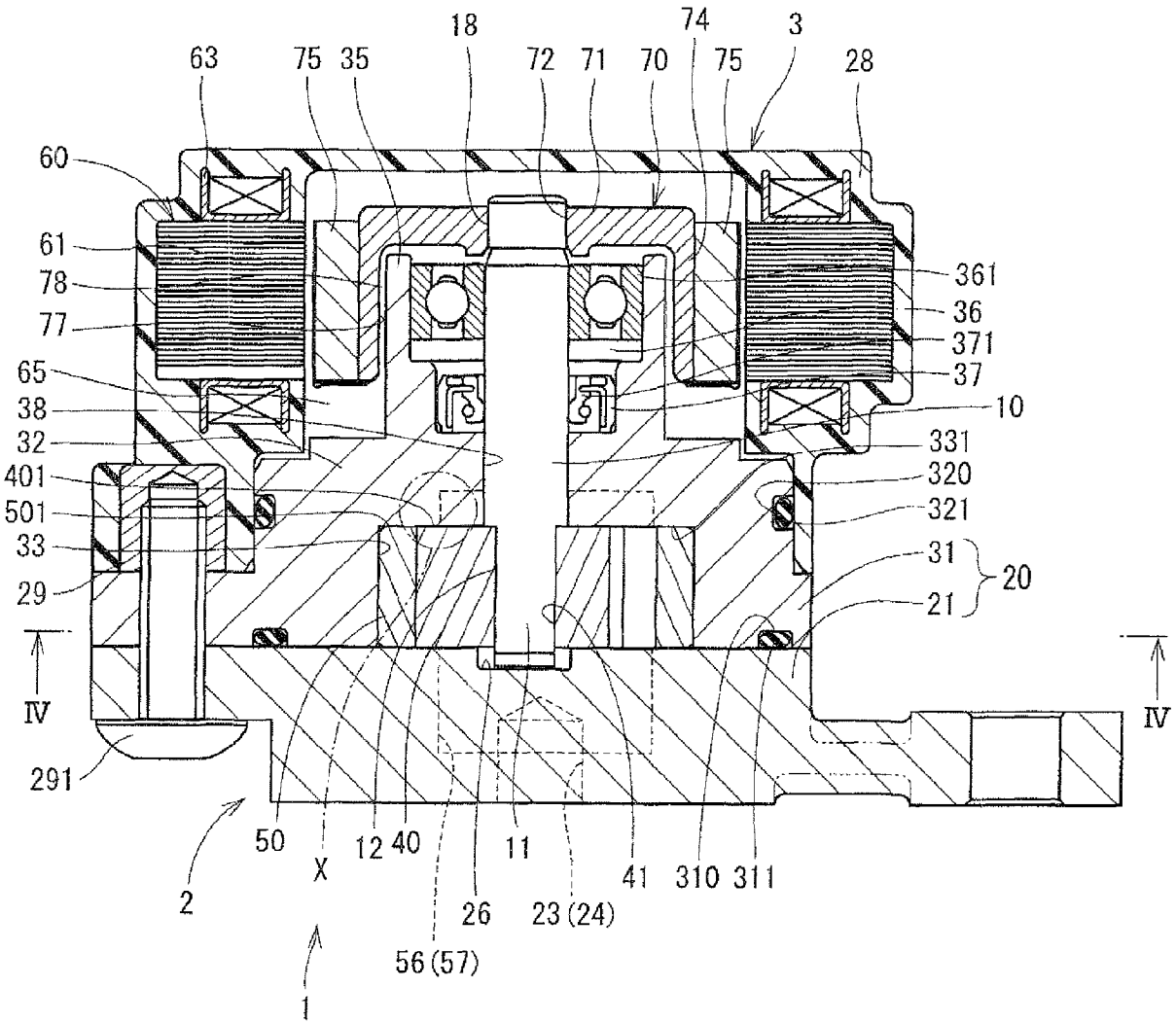
FIG. 3 is a cross-sectional view of the electric pump of the embodiment.
Figure 4:
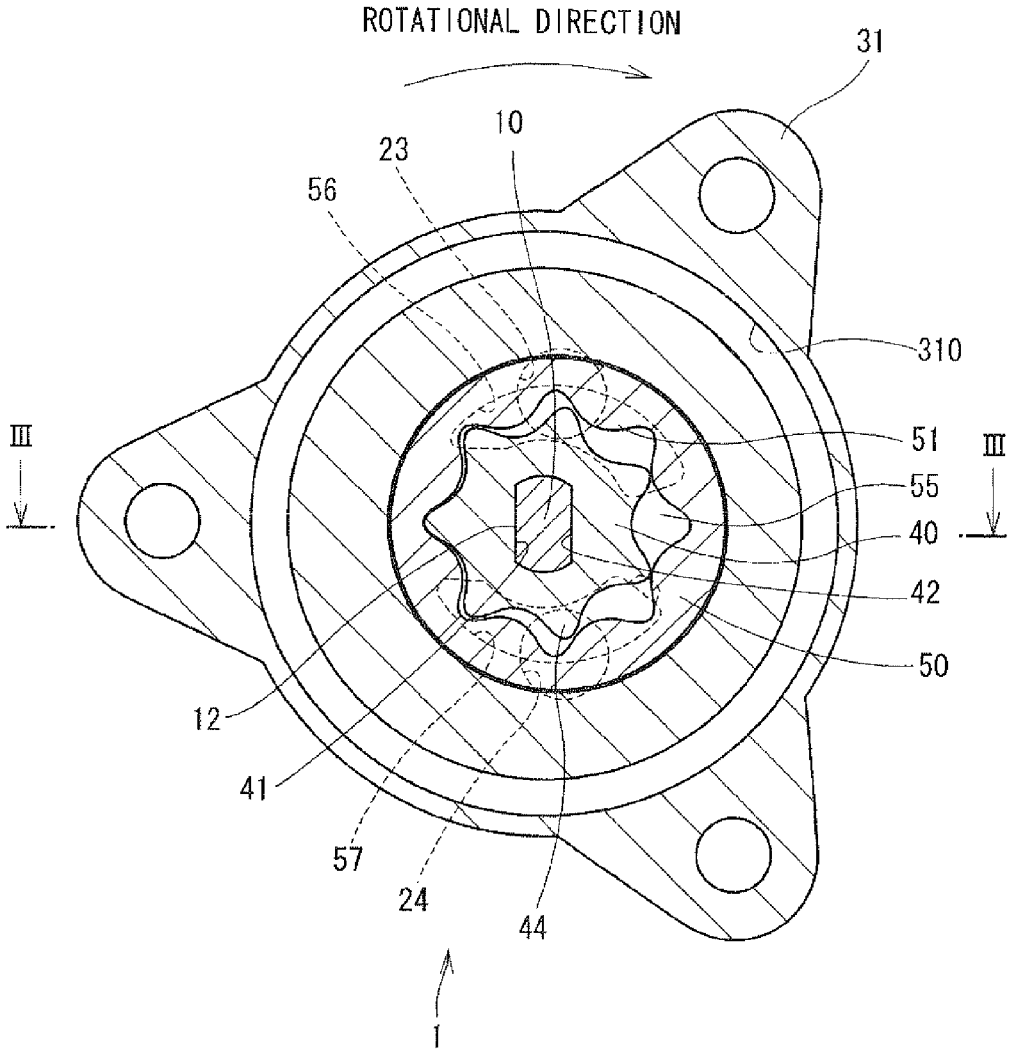
FIG. 4 is a cross-sectional view taken along line IV-IV in FIG. 3.

Next, details of the electric pump 1 will be described with reference to FIGS. 3 and 4. FIG. 3 is a cross-sectional view taken along line III-Ill in FIG. 4. FIG. 4 is a cross-sectional view taken along line IV-IV in FIG. 3.

The pump device 2 of the electric pump 1 is an internal gear rotary pump and includes a housing 20, an inner rotor 40 and an outer rotor 50.

The housing 20 includes a first housing 21 and a second housing 31.

The first housing 21 has an inlet port (suction port) 23 and an outlet port (discharge port) 24. The inlet port 23 is located on a front side of a plane of FIG. 3, and the outlet port 24 is located on a rear side of the plane of FIG. 3. A recess 26 is formed in a contact surface of the first housing 21, which contacts the second housing 31, at a location that corresponds to the shaft 10. One end portion of the shaft 10 is received in the recess 26. The first housing 21 and the shaft 10 do not contact with each other, and the rotation of the shaft 10 is not limited by the first housing 21.

The second housing 31 is configured into a generally cylindrical body. A large diameter portion 32 is formed in one end portion of the second housing 31, which is located on the pump device 2 side in the axial direction. Furthermore, a tubular portion 35, which is configured into a cylindrical tubular form, is formed in the other end portion of the second housing 31, which is located on the motor device 3 side in the axial direction. A pump chamber 33, which receives the inner rotor 40 and the outer rotor 50, is formed in an inside of the large diameter portion 32. The inner rotor 40 and the outer rotor 50 are rotatable relative to the housing 20. Structures of the inner rotor 40 and of the outer rotor 50 will be described later.

A bearing chamber 36, which is coaxial with a rotational axis of the shaft 10, is formed in an end part of the tubular portion 35, which is located on the motor device 3 side in the axial direction. An oil seal chamber 37 is formed on a pump device 2 side of the bearing chamber 36.

A ball bearing 361, which is a type of radial bearing, is inserted in the bearing chamber 36. An outer race of the ball bearing 361 is press fitted to an inner wall of the bearing chamber 36, and the shaft 10 is press fitted into an inner race of the ball bearing 361. In this way, the shaft 10 is supported in a manner that enables rotation of the shaft 10 about a central axis of the tubular portion 35.

An oil seal 371 is inserted in the oil seal chamber 37 to limit inflow of the oil from the pump chamber 33 into the bearing chamber 36.

Furthermore, a bearing hole 38, which rotatably supports the shaft 10, is formed in the second housing 31. The bearing hole 38 communicates between the pump chamber 33 and the oil seal chamber 37. An inner diameter of the bearing hole 38 is slightly larger than an outer diameter of the shaft 10. The oil, which is leaked from the pump chamber 33, is supplied to a gap, which is radially defined between an inner peripheral wall surface of the bearing hole 38 and an outer peripheral surface of the shaft 10, so that a slide resistance, which would be generated upon the rotation of the shaft 10, is reduced. Furthermore, the shaft 10 is rotatably supported at the two locations, i.e., is rotatably supported by the ball bearing 361 and the inner peripheral wall of the bearing hole 38. Thereby, tilting of the shaft 10 upon the rotation of the shaft 10 can be limited.

An O-ring groove 310 is formed in the contact surface of the second housing 31, which contacts the first housing 21. An O-ring 311 is fitted into the O-ring groove 310 to fluid-tightly seal the pump chamber 33. A cover 28, which receives the motor device 3, is fitted to the other end portion of the second housing 31, which is opposite from the first housing 21. Insert nuts 29 are provided in an opening end portion of the cover 28. Bolts 291 are inserted in the second housing 31 and the first housing 21 and are threadably tightly engaged with the insert nuts 29, respectively, so that the second housing 31, the first housing 21 and the cover 28 are fixed together.

An O-ring groove 320 is formed in a contact surface, which is located in an outer peripheral wall of the large diameter portion 32 of the second housing 31 and contacts the cover 28. An O-ring 321 is fitted into the O-ring groove 320 to airtightly seal a drive chamber 65, which is located between the second housing 31 and the cover 28. The second housing 31 and the cover 28 serve as a housing of the pump device 2 and a housing of the motor device 3.

The motor device 3 includes a stator 60 and a rotor 70.

The stator 60 has a magnetic body (magnetic core) 61 and two insulators 63. The magnetic body 61 is formed by stacking a plurality of magnetic sheets one after another. The insulators 63 are made of a non-magnetic material and are placed on two axial sides, respectively, of the magnetic body 61, i.e., upper and lower sides, respectively, of the magnetic body 61 in FIG. 3. Windings are wound around the insulators 63. When an electric current is supplied to the windings, a magnetic field is generated at the magnetic body 61 of the stator 60.

The rotor 70 is configured into a cup-shaped body, which opens toward the pump device 2 side. The rotor 70 is placed in a rotatable manner on a radially inner side of the stator 60. The rotor 70 includes a bottom portion 71 and a peripheral wall portion (tubular wall portion) 74. The peripheral wall portion 74 axially projects from an outer peripheral edge of the bottom portion 71. A hole 72 is formed through the bottom portion 71 to extend along the central axis. A plurality of permanent magnets 75 is attached to an outer peripheral surface of the peripheral wall portion 74 such that the permanent magnets 75 are arranged one after another in the circumferential direction. In the present embodiment, an axial length of each magnet 75 of the rotor 70 is generally the same as an axial length of the magnetic body 61 of the stator 60.

Furthermore, a distal end part of the tubular portion 35 of the second housing 31 is received in a receiving space 78, which is formed by an inner peripheral wall 77 of the rotor 70. A gap is formed between the inner peripheral wall 77 of the rotor 70 and the tubular portion 35 of the second housing 31 to limit contact between the inner peripheral wall 77 of the rotor 70 and the tubular portion 35 of the second housing 31.

The shaft 10 is configured into a generally cylindrical rod body. A fitting shaft portion 11 is formed in one end portion of the shaft 10, and a rotor press-fitting portion 18 is formed in the other end portion of the shaft 10. The rotor press-fitting portion 18 is press fitted into the hole 72 of the rotor 70. In this way, the shaft 10 and the rotor 70 are integrally rotatable.

The fitting shaft portion 11 has two flat surface segments 12, which extend in the axial direction such that the flat surface segments 12 are generally parallel to each other and are diametrically opposed to each other. The flat surface segments 12 are formed to be generally parallel to each other by, for example, a cutting process. A distance between the two flat surface segments 12 is generally the same as a distance between two flat surface segments 42 of a shaft hole 41 of the inner rotor 40, which will be described later. Relative rotation between the shaft 10 and the inner rotor 40 is limited when the fitting shaft portion 11 is fitted into the shaft hole 41 such that the flat surface segments 12 are radially opposed to the flat surface segments 42, respectively. In this way, the shaft 10 and the inner rotor 40 can be rotated integrally. Thereby, the rotor 70, the shaft 10 and the inner rotor 40 can be rotated integrally.

The inner rotor 40 and the outer rotor 50 are made of, for example, sintered iron metal and are rotatably received in a space, which is formed by the pump chamber 33 of the second housing 31 and the first housing 21.

The shaft hole 41 is formed in the inner rotor 40 to extend along the central axis. The shaft hole 41 includes the two flat surface segments 42, which extend in the axial direction such that the fiat surface segments 42 are generally parallel to each other and are diametrically opposed to each other. The flat surface segments 42 are circumferentially connected to each other through two arcuate side surfaces. Seven external teeth 44 are formed along an outer peripheral part of the inner rotor 40.

The outer rotor 50 is configured into a generally cylindrical tubular form and is located on a radially outer side of the inner rotor 40. Eight internal teeth 51 are formed along an inner peripheral part of the outer rotor 50 to mesh with the external teeth 44 of the inner rotor 40. A rotational center (rotational axis) of the outer rotor 50 is eccentric to a rotational center (rotational axis) of the inner rotor 40. A pressure chamber 55 is formed between the inner rotor 40 and the outer rotor 50. The pressure chamber 55 is communicated with an inlet-side oil chamber 56 and an outlet-side oil chamber 57. The inlet-side oil chamber 56 is communicated with the inlet port 23, and the outlet-side oil chamber 57 is communicated with the outlet port 24. In this way, the inlet port 23 and the outlet port 24 are communicated with each other through the inlet-side oil chamber 56, the pressure chamber 55 and the outlet-side oil chamber 57.

In the present embodiment, an axial size of an axial clearance (hereinafter referred to as an inner rotor 40 side clearance), which is formed between the inner rotor 40 and the second housing 31, differs from an axial size of an axial clearance (hereinafter, referred to as an outer rotor side clearance), which is formed between the outer rotor 50 and the second housing 31.

Figure 5A:
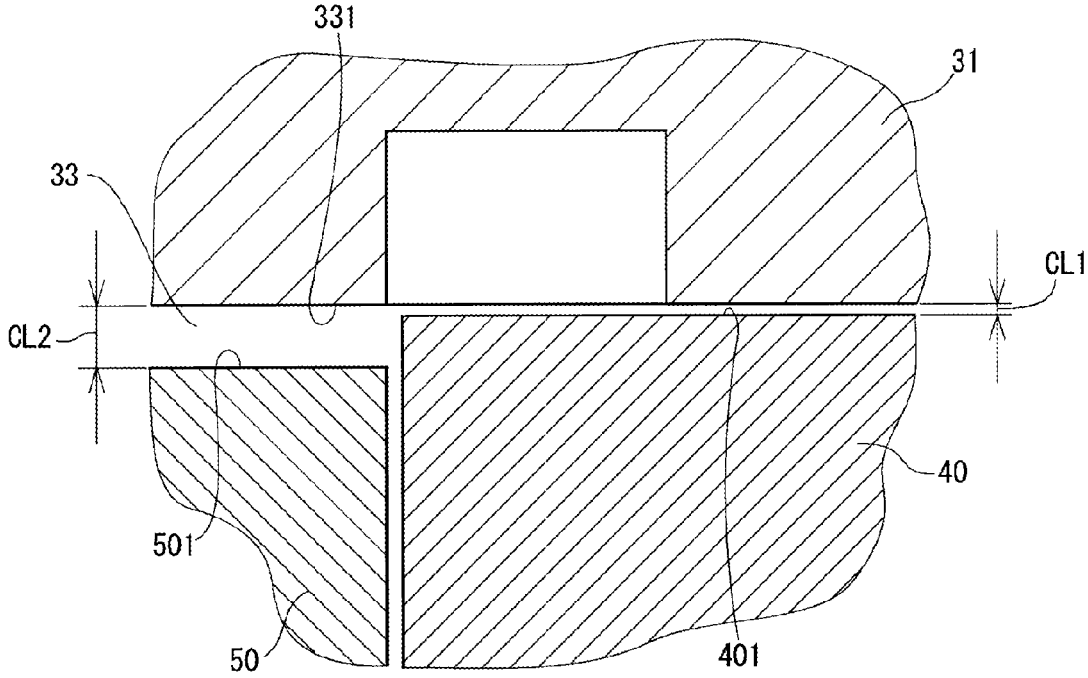
FIG. 5A is an enlarged partial view of a portion X in FIG. 3.

A relationship between the inner rotor 40 side clearance and the outer rotor 50 side clearance will be described with reference to FIG. 5A. FIG. 5A is an enlarged partial view showing an area X in FIG. 3.

As shown in FIG. 5A, the clearance (i.e., the inner rotor 40 side clearance) CL1 is formed between an axial end surface (planar end surface) 331 of the pump chamber 33 of the second housing 31 and an axial end surface 401 of the inner rotor 40, which are axially opposed to each other. Furthermore, the clearance (i.e., the outer rotor 50 side clearance) CL2 is formed between the axial end surface 331 of the pump chamber 33 of the second housing 31 and an axial end surface 501 of the outer rotor 50, which are axially opposed to each other. The axial size of the outer rotor 50 side clearance LC2 is larger than the axial size of the inner rotor 40 side clearance CL1. In the present embodiment, the axial size of the inner rotor 40 side clearance CL1 is made smaller than the axial size of the outer rotor 50 side clearance CL2 by making an axial thickness (axial extent) of the inner rotor 40 larger than an axial thickness (axial extent) of the outer rotor 50.

In a case where the material (e.g., the sintered iron metal) of the inner rotor 40 and of the outer rotor 50 differs from the material (e.g., aluminum) of the second housing 31, a coefficient of linear expansion of the inner rotor 40 and of the outer rotor 50 with respect to a temperature change differs from a coefficient of linear expansion of the second housing 31 with respect to the temperature change. Thereby, the axial size of the inner rotor 40 side clearance CL1 and the axial size of the outer rotor 50 side clearance CL2 change depending on the temperature. Therefore, the axial size of each of the inner rotor 40 side clearance CL1 and the outer rotor 50 side clearance CL2 is set within a corresponding predetermined range, within which locking of the inner/outer rotor 40, 50 does not occur in a storage temperature environmental range, or within which locking of the inner/outer rotor 40, 50 by a foreign object does not occur.

Now, an operation of the electric pump 1 will be described.

When the electric current is supplied to the windings, which are wound around the insulators 63 of the stator 60, the magnetic field is generated in the magnetic body 61 of the stator 60. Due the presence of the thus generated magnetic field, the rotor 70, the shaft 10 and the inner rotor 40 are integrally rotated in a clockwise direction in FIGS. 4, 6A and 6B. Furthermore, when the inner rotor 40 is rotated, the outer rotor 50 is rotated. When the inner rotor 40 and the outer rotor 50 are rotated, the amount of tooth-to-tooth contact (interlocking amount) between the external teeth 44 and the internal teeth 51 continuously changes, so that the volume of the pressure chamber 55 continuously changes. Thereby, the oil is drawn into a volume increasing region of the pressure chamber 55, in which the volume is increasing in response to the rotation, through the inlet port 23 and the inlet-side oil chamber 56. Also, at this time, the oil is discharged from a volume decreasing region of the pressure chamber 55, in which the volume is decreasing in response to the rotation, through the outlet-side oil chamber 57 and the outlet port 24.

Figure 6A:
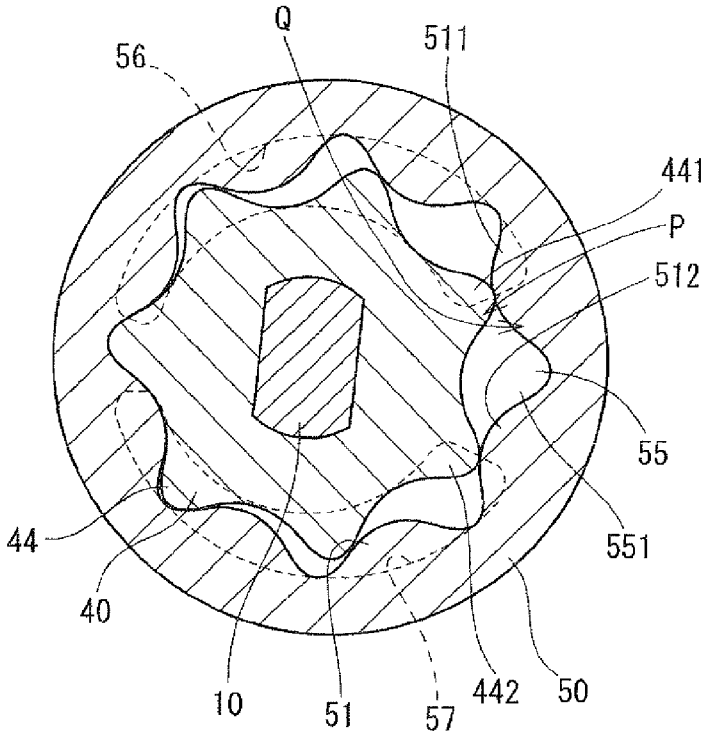
FIG. 6A is a schematic diagram showing an inner rotor and an outer rotor of the electric pump of the embodiment placed in one operational state.
Figure 6B:
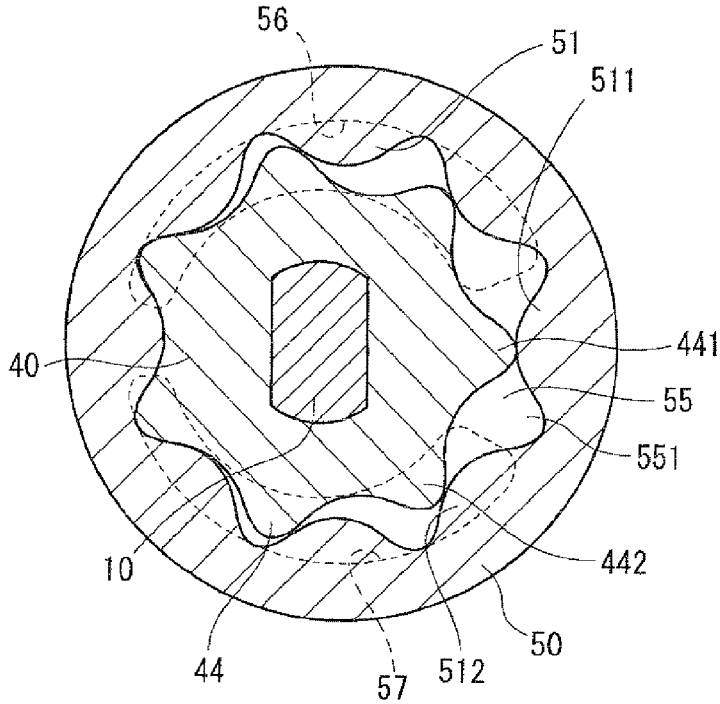
FIG. 6B is a schematic diagram showing the inner rotor and the outer rotor of the electric pump of the embodiment placed in another operational state.

For instance, as shown in FIG. 6A, a pressure chamber 551 is formed by the external tooth 441 and the external tooth 442 among the external teeth 44 of the inner rotor 40 and the internal tooth 511 and the internal tooth 512 among the internal teeth 51 of the outer rotor 50. This pressure chamber 551 is not communicated with both of the inlet-side oil chamber 56 and the outlet-side oil chamber 57. At this time, the pressure of the pressure chamber 551 is high. In FIG. 6B, in which the inner rotor 40 and the outer rotor 50 are rotated from the state of FIG. 6A, the pressure chamber 551 is communicated with the outlet-side oil chamber 57. In this way, the oil of the pressure chamber 551, which is pressurized in the state of FIG. 6A, is discharged to the outlet-side oil chamber 57.

As discussed above, when the pressure chamber 551 is not communicated with both of the inlet-side oil chamber 56 and the outlet-side oil chamber 57, the pressure of the pressure chamber 551 is high. At this time, a portion of the oil in the pressure chamber 551 flows into the inlet-side oil chamber 56. When the portion of the oil, which is trapped in the pressure chamber 551, flows backward into the inlet-side oil chamber 56, a volumetric efficiency is reduced. A boundary region (indicated by "P" in FIG. 6A) of the inner rotor 40 between the pressure chamber 551 and the inlet-side oil chamber 56 is smaller than a boundary region (indicated by "Q" in FIG. 6A) of the outer rotor 50 between the pressure chamber 551 and the inlet-side oil chamber 56. Therefore, the oil of the pressure chamber 551 is likely to flow backward from the region P side, i.e., from the inner rotor 40 side to the inlet-side oil chamber 56.

Now, with reference to FIGS. 7A to 8B, there will be described a relationship between the axial size of the inner rotor 40 side clearance CL1 and the volumetric efficiency, a relationship between the axial size of the outer rotor 50 side clearance CL2 and the volumetric efficiency, a relationship between the axial size of the inner rotor 40 side clearance CL1 and the drive torque, and a relationship between the outer rotor 50 side clearance CL2 and the drive torque.

Figure 7A:
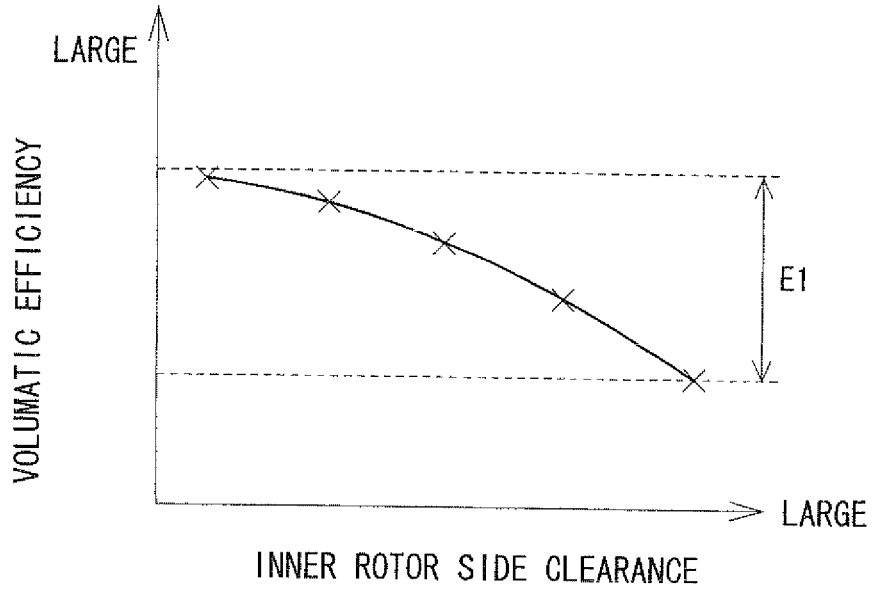
FIG. 7A is a diagram showing a relationship between an inner rotor side clearance and a volumetric efficiency according to the embodiment.
Figure 7B:
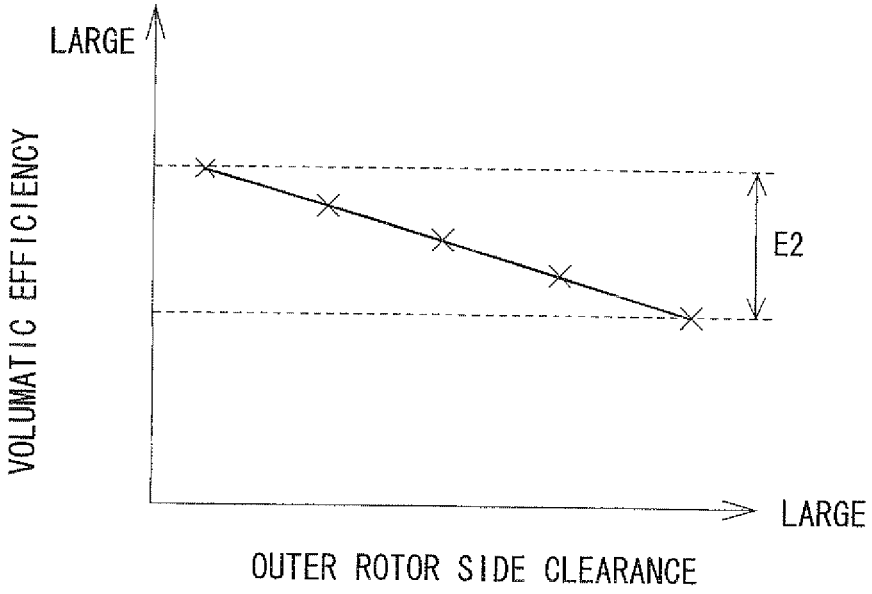
FIG. 7B is a diagram showing a relationship between an outer rotor side clearance and the volumetric efficiency according to the embodiment.
Figure 8A:
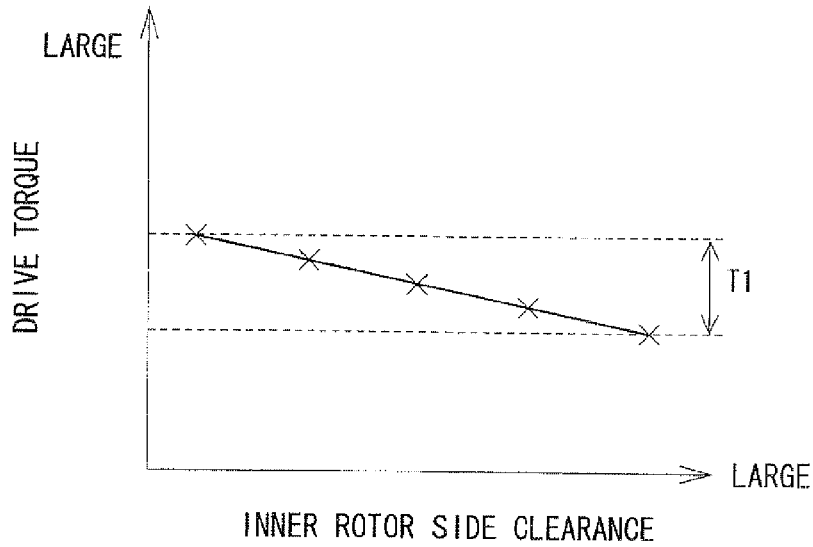
FIG. 8A is a diagram showing a relationship between the inner rotor side clearance and a drive torque.
Figure 8B:
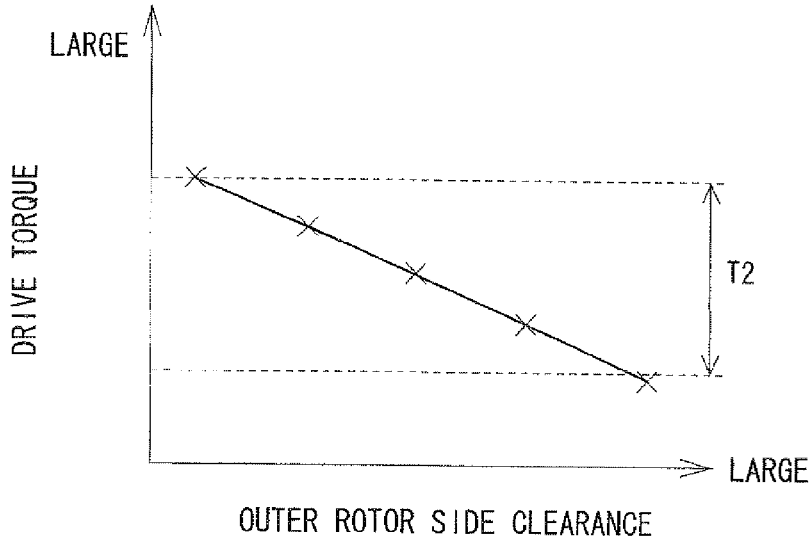
FIG. 8B is a diagram showing a relationship between the outer rotor side clearance and the drive torque.

Specifically, FIG. 7A shows the relationship between the axial size of the inner rotor 40 side clearance CL1 and the volumetric efficiency, and FIG. 7B shows the relationship between the axial size of the outer rotor 50 side clearance CL2 and the volumetric efficiency. FIG. 8A shows the relationship between the axial size of the inner rotor 40 side clearance CL1 and the drive torque, which is required to drive, i.e., rotate the inner rotor 40 and the outer rotor 50. FIG. 8B shows the relationship between the axial size of the outer rotor 50 side clearance CL2 and the drive torque, which is required to drive, i.e., rotate the inner rotor 40 and the outer rotor 50. FIGS. 7A to 8B are used to describe the case where the automatic transmission fluid (ATF) temperature is 80 degrees Celsius, which is the normal temperature of the ATF.

As shown in FIGS. 7A and 7B, in a case where the axial size of each of the inner rotor 40 side clearance CL1 and the outer rotor 50 side clearance CL2 is changed by the same amount, a change E1 in the volumetric efficiency, which is observed by changing the axial size of the inner rotor 40 side clearance CL1, is larger than a change E2 in the volumetric efficiency, which is observed by changing the axial size of the outer rotor 50 side clearance CL2. That is, there is the relationship of E1>E2. As discussed above, the oil of the pressure chamber 551 is likely to flow backward from the inner rotor 40 side. Therefore, the volumetric efficiency can be effectively improved by reducing the axial size of the inner rotor 40 side clearance CL1.

As shown in FIGS. 8A and 8B, in a case where the axial size of each of the inner rotor 40 side clearance CL1 and the outer rotor 50 side clearance CL2 is changed by the same amount, a change T2 in the drive torque, which is observed by changing the axial size of the outer rotor 50 side clearance CL2, is larger than a change T1 in the drive torque, which is observed by changing the axial size of the inner rotor 40 side clearance CL1, due to the fact that the surface area of the axial end portion of the outer rotor 50 is larger than the surface area of the axial end portion of the inner rotor 40. That is, there is the relationship of T1<T2. Thus, the drive torque can be effectively reduced by increasing the axial size of the outer rotor 50 side clearance CL2 in comparison to the axial size of the inner rotor 40 side clearance CL1.

As discussed above, according to the present embodiment, the axial size of the inner rotor 40 side clearance CL1, which is formed between the axial end surface 331 of the pump chamber 33 of the second housing 31 and the axial end surface 401 of the inner rotor 40, differs from the axial size of the outer rotor 50 side clearance CL2, which is formed between the axial end surface 331 of the pump chamber 33 of the second housing 31 and the axial end surface 501 of the outer rotor 50. In this way, in comparison to the case where both of the axial size of the inner rotor 40 side clearance CL1 and the axial size of the outer rotor 50 side clearance CL2 are reduced, the volumetric efficiency can be improved while limiting the increase in the drive torque according to the present embodiment, which uses the simple structure described above.

Particularly, in the present embodiment, the axial size of the inner rotor 40 side clearance CL1 is smaller than the axial size of the outer rotor 50 side clearance CL2. A larger ratio of improvement can be obtained in the case where the axial size of the inner rotor 40 side clearance CL1 is made smaller than the axial size of the outer rotor 50 side clearance CL2 in comparison to the comparative case where the axial size of the outer rotor 50 side clearance CL2 is made smaller than the axial size of the inner rotor 40 side clearance CL1. Furthermore, a larger drive torque is required in the case where the axial size of the outer rotor 50 side clearance CL2 is made smaller than the axial size of the inner rotor 40 side clearance CL1 in comparison to the case where the axial size of the inner rotor 40 side clearance CL1 is made smaller than the axial size of the outer rotor 50 side clearance CL2.

According to the present embodiment, the axial size of the outer rotor 50 side clearance CL2 is made relatively large, and the axial size of the inner rotor 40 side clearance CL1 is made smaller than the axial size of the outer rotor 50 side clearance CL2. Therefore, with the simple structure, the volumetric efficiency can be improved while limiting the increase in the required drive torque.

Furthermore, in the present embodiment, the axial thickness (axial extent) of the inner rotor 40 is larger than the axial thickness (axial extent) of the outer rotor 50. In general, the inner rotor 40 and the outer rotor 50 are manufactured separately. Therefore, even when the axial thickness of the inner rotor 40 differs from the axial thickness of the outer rotor 50, it will not result in an increase in the number of the manufacturing steps. Therefore, it is possible to reduce the axial size of the inner rotor 40 side clearance CL1 relative to the axial size of the outer rotor 50 side clearance CL2 without increasing the number of manufacturing steps.

The present invention is not limited to the above embodiment, and the above embodiment may be modified in the following manner.

Figure 5B:
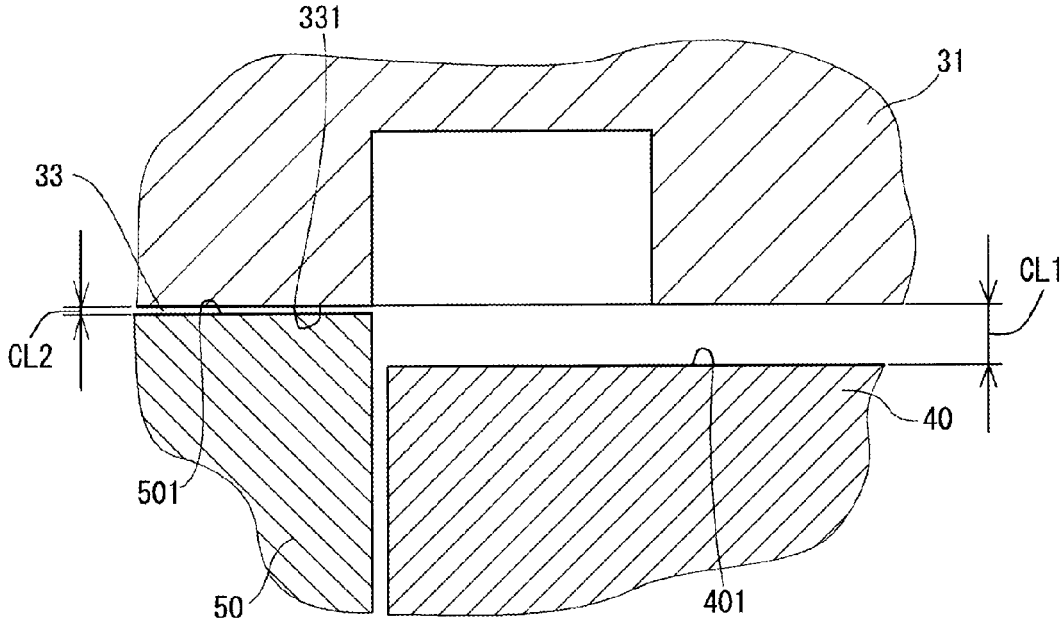
FIG. 5B is an enlarged partial view showing a modification of a structure shown in FIG. 5A.

In the above embodiment, the axial size of the inner rotor 40 side clearance CL1 is smaller than the axial size of the outer rotor 50 side clearance CL2. Alternatively, the axial size of the outer rotor 50 side clearance CL2 may be made smaller than the axial size of the inner rotor 40 side clearance CL1 by making the axial thickness (axial extent) of the outer rotor 50 larger than the axial thickness (axial extent) of the inner rotor 40, as shown in FIG. 5B. In this way, the axial size of the inner rotor 40 side clearance and the axial size of the outer rotor 50 side clearance can be made different from each other.

In the above embodiment, there is provided the internal gear pump, in which the number of the teeth of the inner rotor 40 is seven, and the number of the teeth of the outer rotor 50 is eight The number of the teeth of the inner rotor 40 and the number of the teeth of the outer rotor 50 may be modified to any other appropriate numbers based on the required discharge rate of the gear pump. In such a case, the number of the internal teeth of the outer rotor should be larger than the number of the external teeth of the inner rotor by one.

Furthermore, a crescent partition, which is configured into a crescent shape, may be provided between the inner rotor 40 and the outer rotor 50 to limit leakage of the fluid from the high pressure side toward the low pressure side. In the case where the crescent partition is provided, the number of the internal teeth of the outer rotor 50 is set to be larger than the number of the external teeth of the inner rotor 40 by at least one (e.g., by two).

The rotary pump of the above embodiment is the electric pump, which is driven by the electric motor. However, the present invention is not limited to the electric pump and may be applied to a rotary pump, which is driven by other power (energy), such as the mechanical force of the engine, hydraulic pressure, air pressure (pneumatic pressure).

Furthermore, in the above embodiment, the rotary pump is the oil pump, which pumps the oil. However, the fluid, which is pumped by the rotary pump of the present invention, is not limited to the oil. For instance, the fluid, which is pumped by the rotary pump of the present invention may be any other type of fluid, such as water, that is, the rotary pump may be a water pump.

The motor device of the above embodiment is formed as a surface permanent magnet (SPM) motor. However, the motor device of the rotary pump of the present invention may be changed to any other type of motor, such as an interior permanent magnet (IPM) motor. Furthermore, in the above embodiment, the permanent magnets are attached to the rotor. Here, it should be understood that the number of the magnetic poles of the magnets can be any appropriate number. Also, in place of the multiple magnets 75, a single annular permanent magnet having alternating magnetic poles may be used.

Furthermore, in the above embodiment, the axial length of the stator is generally the same as the axial length of the rotor. Alternatively, the axial length of the stator and the axial length of the rotor may be made different from each other.

Furthermore, in the above embodiment, the rotary pump is applied in the automatic transmission of the vehicle (specifically, the automobile). Alternatively, the rotary pump of the present invention may be applied in any other apparatus or system of any appropriate technical field as long as the rotary pump pumps fluid.

The present invention is not limited the above embodiment and modifications thereof. That is, the above embodiment and modifications thereof may be modified in various ways without departing from the sprit and scope of the invention.

What is claimed is:

1. A rotary pump comprising:

a shaft that is rotatable;

a drive device that generates a rotational drive force to rotate the shaft;

an inner rotor that includes a plurality of external teeth and is adapted to be rotated integrally with the shaft by the rotational drive force, which is received from the drive device;

an outer rotor that includes a plurality of internal teeth meshed with the plurality of external teeth and is placed eccentric to the inner rotor on a radially outer side of the inner rotor, wherein the inner rotor and the outer rotor form a pressure chamber therebetween, and a volume of the pressure chamber is variable upon rotation of the inner rotor;

a first housing that includes:

an inlet port, which is communicated with the pressure chamber to supply fluid into the pressure chamber; and an outlet port, which is communicated with the pressure chamber to discharge the fluid from the pressure chamber; and a second housing that includes a pump chamber, which receives the inner rotor and the outer rotor in a rotatable manner, wherein;

an axial size of an axial clearance, which is formed between an axial end surface of the pump chamber and an axial end surface of the inner rotor, differs from an axial size of an axial clearance, which is formed between the axial end surface of the pump chamber and an axial end surface of the outer rotor; and the axial size of the axial clearance, which is formed between the axial end surface of the pump chamber and the axial end surface of the inner rotor, is smaller than the axial size of the axial clearance, which is formed between the axial end surface of the pump chamber and the axial end surface of the outer rotor.

2. The rotary pump according to claim 1, wherein an axial thickness of the inner rotor is larger than an axial thickness of the outer rotor.

3. A rotary pump comprising:

a shaft that is rotatable;

a drive device that generates a rotational drive force to rotate the shaft;

an inner rotor that includes a plurality of external teeth and is adapted to be rotated integrally with the shaft by the rotational drive force, which is received from the drive device;

an outer rotor that includes a plurality of internal teeth meshed with the plurality of external teeth and is placed eccentric to the inner rotor on a radially outer side of the inner rotor, wherein the inner rotor and the outer rotor form a pressure chamber therebetween, and a volume of the pressure chamber is variable upon rotation of the inner rotor;

a first housing that includes:

an inlet port, which is communicated with the pressure chamber to supply fluid into the pressure chamber; and an outlet port, which is communicated with the pressure chamber to discharge the fluid from the pressure chamber; and a second housing that includes a pump chamber, which receives the inner rotor and the outer rotor in a rotatable manner, wherein;

an axial size of an axial clearance, which is formed between an axial end surface of the pump chamber and an axial end surface of the inner rotor, differs from an axial size of an axial clearance, which is formed between the axial end surface of the pump chamber and an axial end surface of the outer rotor; and the axial size of the axial clearance, which is formed between the axial end surface of the pump chamber and the axial end surface of the outer rotor, is smaller than the axial size of the axial clearance, which is formed between the axial end surface of the pump chamber and the axial end surface of the inner rotor.

4. The rotary pump according to claim 3, wherein an axial thickness of the outer rotor is larger than an axial thickness of the inner rotor.

* * * * *